United States Patent [19]

Frambach

[11] Patent Number: 5,038,537

[45] Date of Patent: Aug. 13, 1991

[54] WINDOW SYSTEM AND STRUCTURE

[76] Inventor: Harry Frambach, 130 Powell Rd., Allendale, N.J. 07401

[21] Appl. No.: 486,789

[22] Filed: Mar. 1, 1990

Related U.S. Application Data

[63] Continuation of Ser. No. 313,091, Feb. 21, 1989, abandoned.

[51] Int. Cl.[5] ..... E06B 1/04

[52] U.S. Cl. ..... 52/207; 52/204; 49/400; 49/DIG. 1

[58] Field of Search ..... 52/208, 213, 204, 207; 49/DIG. 1, 400, 401, 402

[56] References Cited

U.S. PATENT DOCUMENTS

| | | | |
|---|---|---|---|
| 1,907,091 | 5/1933 | Pettit | 49/401 |
| 2,612,662 | 10/1952 | Pfaff | 52/207 X |
| 4,409,769 | 10/1983 | Redman | 49/DIG. 1 X |
| 4,447,985 | 5/1984 | Weber et al. | 49/DIG. 1 X |
| 4,875,316 | 10/1989 | Johnston | 52/204 |

FOREIGN PATENT DOCUMENTS

| | | | |
|---|---|---|---|
| 399264 | 10/1933 | United Kingdom | 49/400 |

*Primary Examiner*—David A. Scherbel

*Assistant Examiner*—Creighton Smith

*Attorney, Agent, or Firm*—W. Patrick Quast

[57] ABSTRACT

A window structure for use as a new or a replacement window in a wall opening is provided. This window structure includes, a tubular interior frame unit, a tubular exterior frame unit, insulating glass units, and seal means between the frame units. The tubular exterior frame unit overlaps and has substantially the same projected member width as the tubular interior frame unit for providing a slim appearance to the metal parts and for providing a large appearance to the glass parts. The tubular interior frame unit has a first tubular frame portion, and has a second flange frame portion, and has a third heat-barrier frame portion therebetween, for minimizing heat loss. Each insulating glass unit has two spaced glass sheets with a sealed air space therebetween. The seal means has a continuous primary seal member mounted on the first tubular frame portion for engaging a tubular exterior operable outswing casement frame of the tubular exterior frame unit. A horizontal bar and a vertical mullion with an upper vertical post are provided, and dual casement windows with dual fixed transom windows are provided, in the tubular exterior frame unit.

19 Claims, 8 Drawing Sheets

WINDOW SYSTEM AND STRUCTURE

This is a continuation of application Ser. No. 07/313,091, filed Feb. 21, 1989, now abandoned.

The invention relates to a window structure, and in particular, the invention relates to an aluminum window structure having a combination of parts including a three-piece tubular interior frame, an operable tubular casement frame, an insulating glass unit and a continuous seal. These are arranged to provide a replacement window suitable particularly for use in 50 year old buildings.

BACKGROUND OF THE INVENTION

Now that Art Deco buildings are 50 years old and Federal, State, and Municipal agencies have designated these buildings as landmarks, there is a need for appropriate replacement windows for the non-insulated, leaky (and even disintegrating) windows used in those buildings. The original windows were slim steel casements that represented modernity and high technology to architects working in the Bauhaus, Art Deco, and Streamlined styles. Preservation regulatory agencies require that the original appearance be maintained in these "significant" buildings. The agencies' mandate covers the less numerous but equally "significant" Tudor and Gothic revival buildings as well.

The replacement window must be compatible aesthetically with the architecture of that era. Also, desirably, the design should be responsive to current industry and government standards.

Aesthetically, the steel window appearance to be replicated comprises:

1. a two inch masonry-to-glass perimeter sightline;
2. a three inch glass-to-glass sightline at primary operable-to-operable and operable to fixed framing members;
3. a putty slope, mitred corner appearance around each operable and fixed light with exterior face of glass set back one inch from face of exterior of window frame;
4. an uninterrupted narrow reveal around casement leaves; and,
5. endless elevation layouts combining fixed and operable lights, where operable lights are virtually indistinguishable from fixed lights.

Current industry and government standards require replacement windows: to minimize energy losses (therefore thermal breaks and insulating glass are desired); to permit interior glazing and reglazing; to have maintenance free finishes; to enable the utilization of standard hardware, including cleaning hinges, locks, etc.

Prior to the present invention there have existed several approaches to manufacturing a window which replicates the architecturally desirable appearance of the outside putty glazed, outswinging steel windows used in buildings of earlier eras; or which incorporates current industry and government mandated performance criteria. However, no one design accomplishes everything.

For example, techniques for replicating these steel windows prior to the present invention have comprised:

1. manufacturing them from similar new, steel shapes, which are outside, putty glazed. This approach creates cost and safety problems attendant upon exterior glazing and reglazing and exterior painting, especially so on high-rise buildings. Further, the use of insulating glass is prohibited.

2. Manufacturing them from extruded aluminum shapes. This has been accomplished easily for wholly fixed windows by incorporating the mitered corner, putty-bevel recessed glass look into the aluminum extrusion. This fixed window incorporates thermal separation, permanent exterior finishes, interior glazing and reglazing capability of insulating glass. The same low (2") sight-line and performance features can be incorporated into a single casement or projected ventilator in its own frame, but cannot be integrated with another ventilator or fixed light in a single frame.

3. Manufacturing them from aluminum by a process generally termed "architectural metals". By this means, windows with an outside putty glazed, steel window appearance can be custom fabricated, virtually handmade, in any combination of fixed and operable lights as of old. They can even incorporate thermal separation, insulating glass, interior glazing and reglazing and permanent finishes. And, in spite of the fact that aluminum is only ⅓ as strong as steel, they can also be made strong enough to withstand windloads and water and air penetration. However, this customized approach cannot incorporate user friendly hardware while simultaneously maintaining high performance standards, since there is just not enough room for the right hardware if the necessary amount of metal for strength is used; and vice versa. More importantly, because this is a customized approach, the issue is academic because windows made in this fashion are far too costly for general acceptance except for use in a few monumental buildings, atriums, etc.

4. Combining in separate frames or integrating into a single frame, commonly manufactured 2" to 2½" deep, aluminum filed, projected and casement windows, forming a grid identical in function to the old windows. They can be manufactured with universally available mechanical components of proven reliability. Likewise, thermal separation, insulating glass, interior glazing and reglazing and maintenance-free finishes are available and cost-efficient. Aesthetically, however, their appearance is far from that of the steel windows. These conventional operable aluminum windows have 3" to 3½" perimeter sight lines and 4½" to 6" internal framing sight lines. The exterior frame is flat with only 3/16" to 5/16" set-back of glass. Separate frames mullioned together create a 6" to 8" glass-to-glass sight line as compared to 4" glass-to-glass for old steel windows. For whatever style building architects intend their use, this flat, wide appearance can intentionally be made part of the overall design. However, where a slim, non-flat appearance is needed for either post-modern or revivalist architecture, or for replacement of old steel windows in architecturally significant existing buildings, conventional aluminum windows are not satisfactory.

Therefore, it is a primary object of this invention to provide a window system which aesthetically replicates the steel window of old;.while responding to the performance demands of government and industry.

It is yet another object of this invention to provide a window system which is mass produceable and cost effective for both the retrofit and new construction markets.

It is still yet another object of this invention to provide a window system which permits the combination of fixed and operable lights in a myriad of configurations, limited, virtually, by the architects creativity.

SUMMARY OF THE INVENTION

According to the present invention, a window structure is provided. This window structure includes a tubular interior window frame having a first frame piece and a second frame piece and a third heat barrier frame piece disposed therebetween; a tubular horizontal bar and vertical mullion; a tubular exterior operable frame hinged to the second frame piece; respective insulating glass units having two spaced glass sheets enclosing a sealed air space, mounted on the tubular exterior fixed and operable frames; and a continuous primary seal member mounted on the first frame piece, horizontal bar and mullion for engaging the fixed and operable exterior frames. The tubular exterior operable frame includes a perpendicular extension member for engaging the continuous primary seal member, which results in an equalized pressure cavity, exteriorally disposed of the extension member, which impedes rain penetration especially in high wind situations. The horizontal bar includes a main tubular portion and a removeable supplementary tubular portion which permits the glazing and reglazing of the fixed insulating glass unit from the interior. The tubular members are made of extruded aluminum and have a predetermined section modulus and moment of inertia to provide necessary windload resistance. The tubular design for the fixed and operable frames have a predetermined contour and dimensions whereby the outside putty glazed steel windows of, for example, the Art Deco era can be replicated in appearance while permitting the necessary strength for the application; and, the two inch and three inch lines of sight, at the perimeter, and glass to glass respectively.

The foregoing and other objects, features and advantages will be apparent from the following description of the preferred embodiment of the invention as illustrated in the accompanying drawings.

DESCRIPTION OF THE PREFERRED EMBODIMENT

Figure 1:
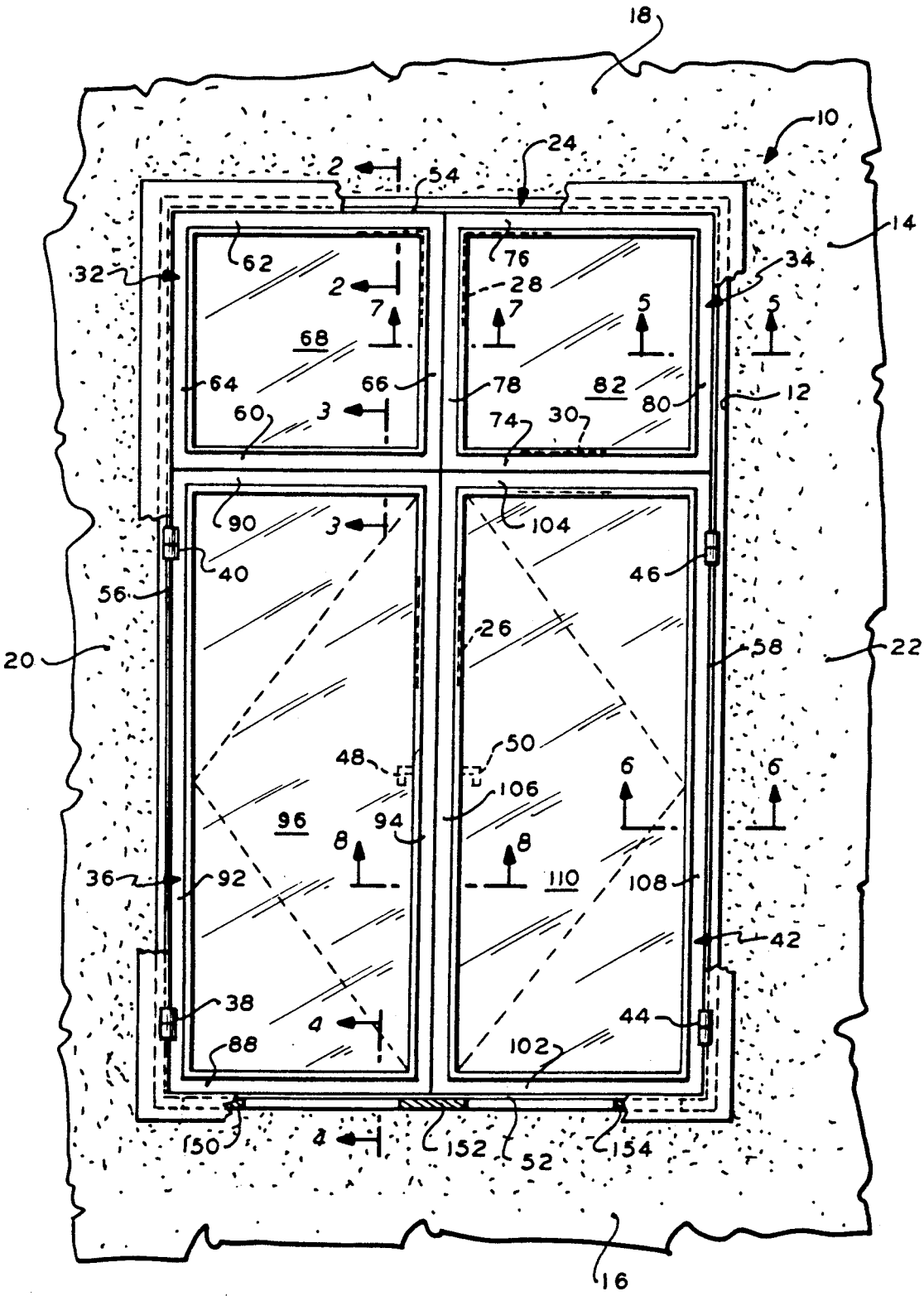
FIG. 1 is an exterior elevation view of a window structure according to the invention.

FIG. 1, which is an exterior view, shows a window system 10, which fits into a wall opening 12 of a wall 14. Wall 14, when looking from the exterior has a bottom portion 16, a top portion 18, a left portion 20, and a right portion 22. As shown in FIG. window system 10 includes an interior or inner tubular perimeter frame 24; a vertical tubular meeting rail 26 and 28; and a horizontal tubular transom bar 30. System 10 also includes a left fixed window frame 32, and a right fixed window frame 34. System 10 also has left operable outswing casement window frame 36, which has side hinges 38, 40, and has a right operable outswing casement window frame 42, which has side hinges 44, 46. Left and right window frames 36, 42, have respective lock handles 48, 50.

As shown in FIG. 1, inner frame 24 is a four-sided frame. Frame 24, looking from the exterior has a bottom sill member 52, a top head member 54, a left jamb member 56 and a right jamb member 58. Members 52, 54, 56, 58 are aluminum tubular members.

As shown in FIG. 1, left fixed window frame 32, when looking from the exterior, has a four-sided tubular, exterior frame member including a bottom member 60, a top member 62, a left member 64, a right member 66, and an insulating glass unit 68 with outer and inner sheets 70, 72. Members 60, 62, 64 66, are aluminum tubular members. The right fixed window frame 34 has a four-sided tubular, exterior frame member including a bottom member 74, a top member 76, a left member 78, a right member 80 and an insulating glass unit 82 with outer and inner sheets 84, 86. Members 74, 76, 78, 80 are aluminum tubular members. The left operable window frame 36 has a four-sided tubular, exterior frame member including a bottom member 88, a top member 90, a left member 92, a right member 94 and an insulating glass unit 96 with outer and inner sheets 98, 100. Members 88, 90, 92 and 94 are aluminum tubular members. The right operable window frame 42 also has a bottom member 102, a top member 104, a left member 106, a right member 108, and an insulating glass unit 110 with outer and inner structurally connected sheets 112, 114. Members 102, 104, 106, 108 are aluminum tubular members.

Figure 4:
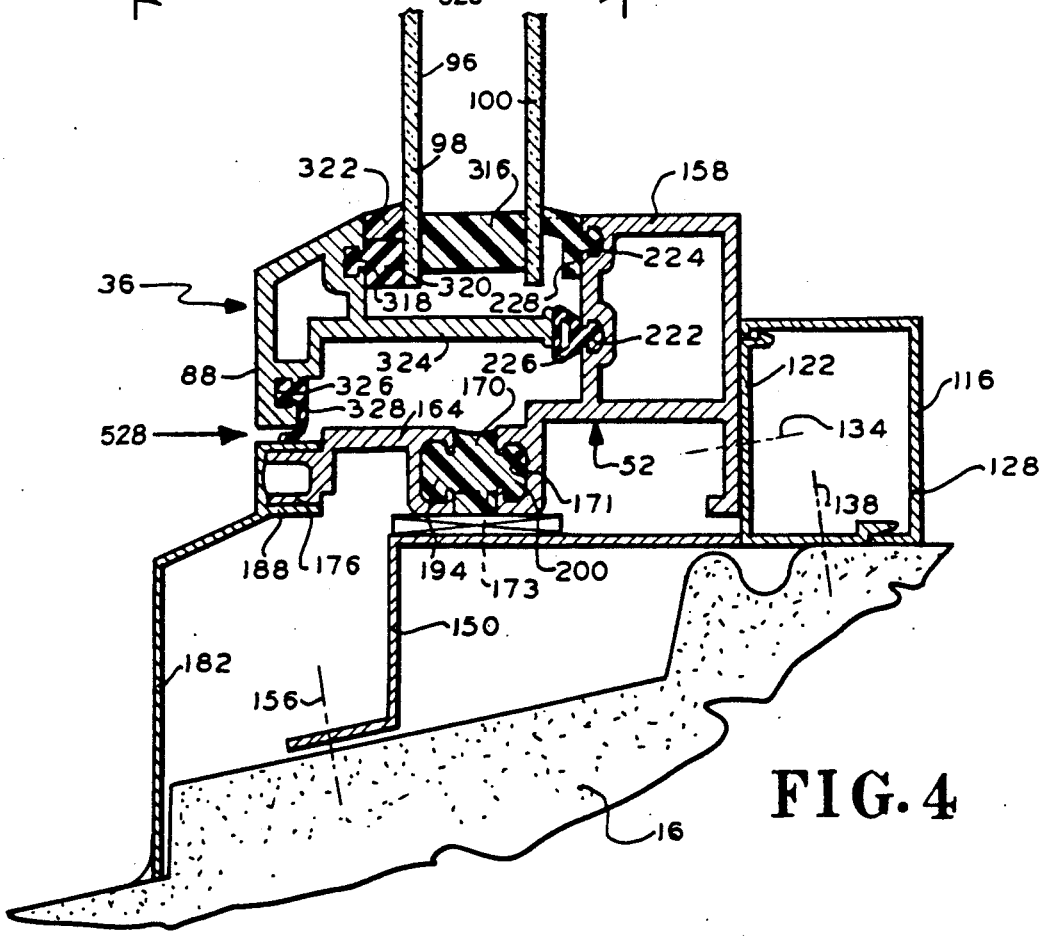
FIG. 4 is a section view as taken along line 4—4 of FIG. 1.
Figure 5:
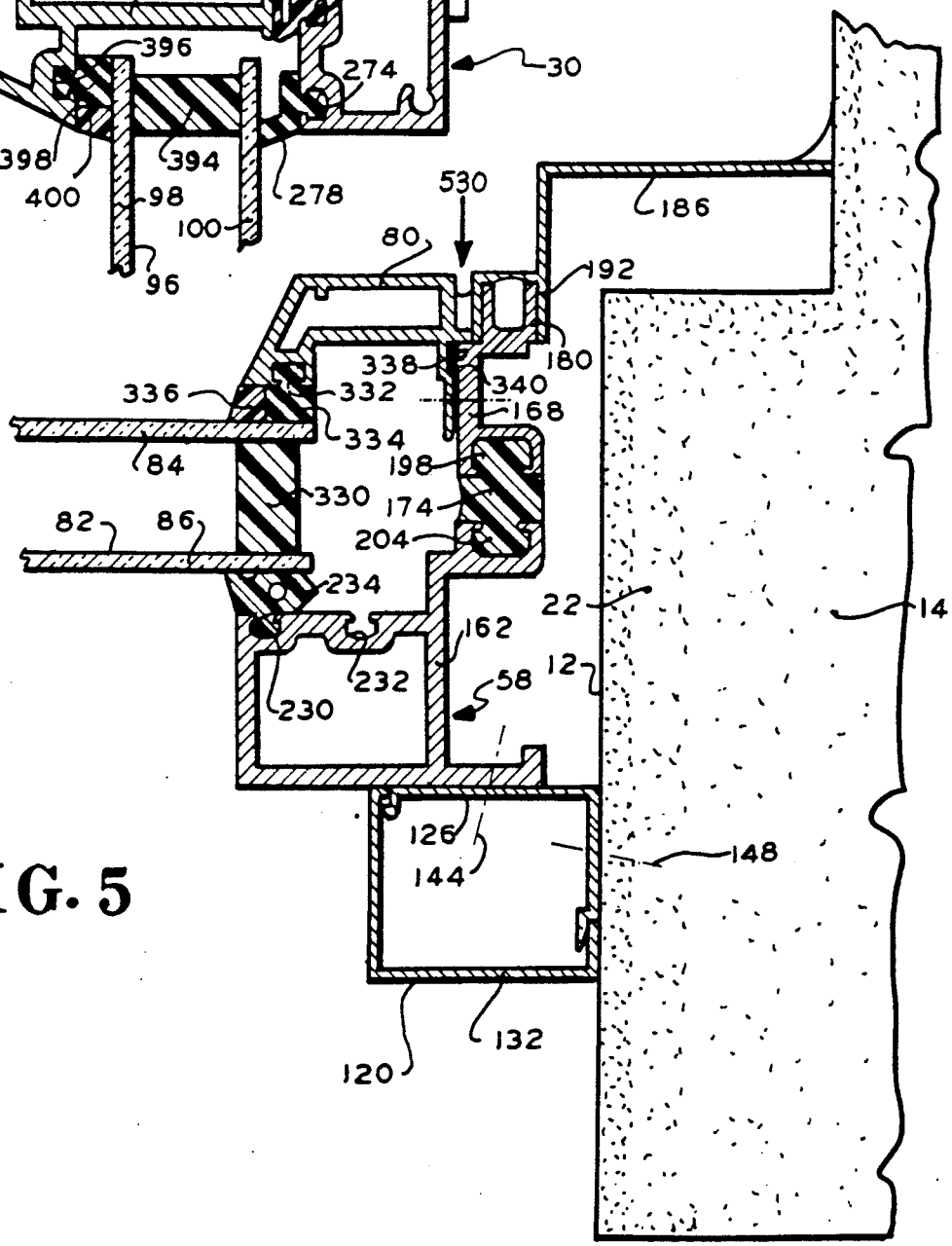
FIG. 5 is a section view as taken along line 5—5 of FIG. 1.
Figure 6:
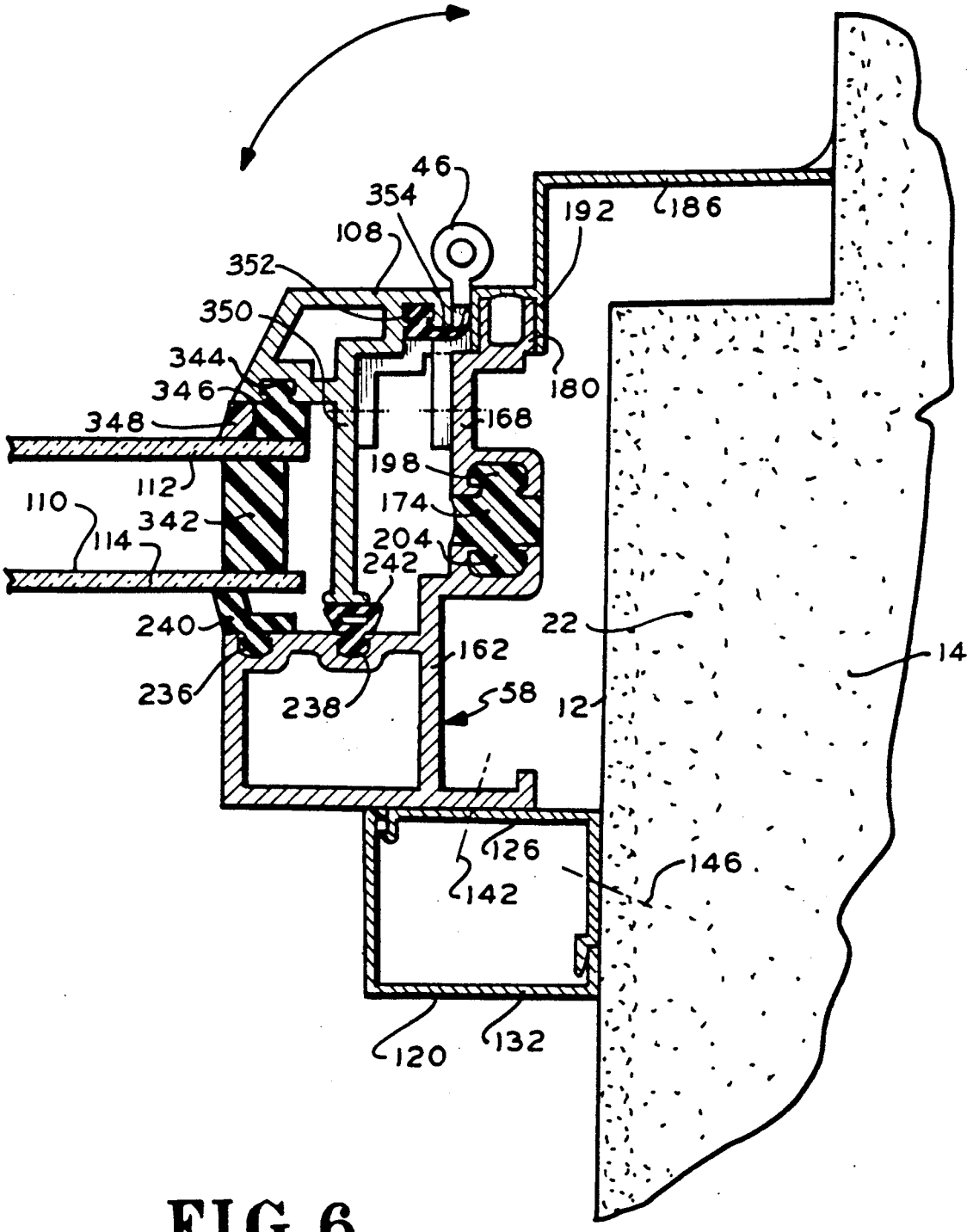
FIG. 6 is a section view as taken along line 6—6 of FIG. 1.

As shown in FIGS. 2, 4, 5 and 6, inner frame 24 has a bottom trim member 116 (FIG. 4); a top trim member 118 (FIG. 2); and a right trim member 120 (FIGS. 5 and 6). A similar left trim member, (not shown) is also provided on the side of the window system opposite right trim member 120. Trim members 116, 118, 120 have respective L-shaped base portions 122, 124, 126; and have respective L-shaped cover portions 128, 130, 132, which respectively connect to and snap over base portions 122, 124, 126, at the edges thereof. The left trim member which is not shown has the same construction but is opposite hand to right trim member 120. Bottom and top trim members 116, 118, (FIGS. 2, 4) have respective screws 134, 136, which attach to respective bottom and top inner frame members 52, 54; and have respective screws 138,, 140, which attach to respective wall portions 16, 18. Right trim base portion 120 (FIGS. 5, 6) has a pair of screws 142, 144, which attach to right inner frame member 58, and has a pair of screws 146, 148, which attach to wall portion 22. Left trim member, not shown, has the same construction as right trim member 120.

As shown in FIGS. 1 and 4, bottom frame member 52 is supported on three support clips 150, 152, 154, which have a plurality of screws 156, that connect clips 150, 152, 154 to bottom wall portion 16.

As shown in FIGS. 4, 2, 5 and 6, bottom frame member 52, top frame member 54, and right frame member 58 have respective main tubular portions 158, 160, 162 and have respective flange plate portions 164, 166, 168. Flanges 164, 166, 168 have respective thermal barriers or joint inserts 170, 172, 174 in order to minimize conduction of heat to or from the exterior, through flanges 164, 166, 168. Flanges 164, 166, 168, have respective panning sheets 182, 184, 186, which have enlarged resilient edge portions 188, 190, 192, that respectively connect to and snap over flange edge portions 176, 178, 180. Inserts 170, 172, 174 respectively have opposite connector edges 194, 196, 198 and 200, 202, 204. Inserts 170, 172, 174 are formed by pouring liquid polyurethane into the extrusion cavity such as 171 in FIG. 4. At the time of the pour, the extrusion includes a bridging member 173 shown in dotted lines, which is cut out after the polyurethane has set. Left frame member 56 has the same construction, but is opposite hand, to right frame member 58.

Figure 2:
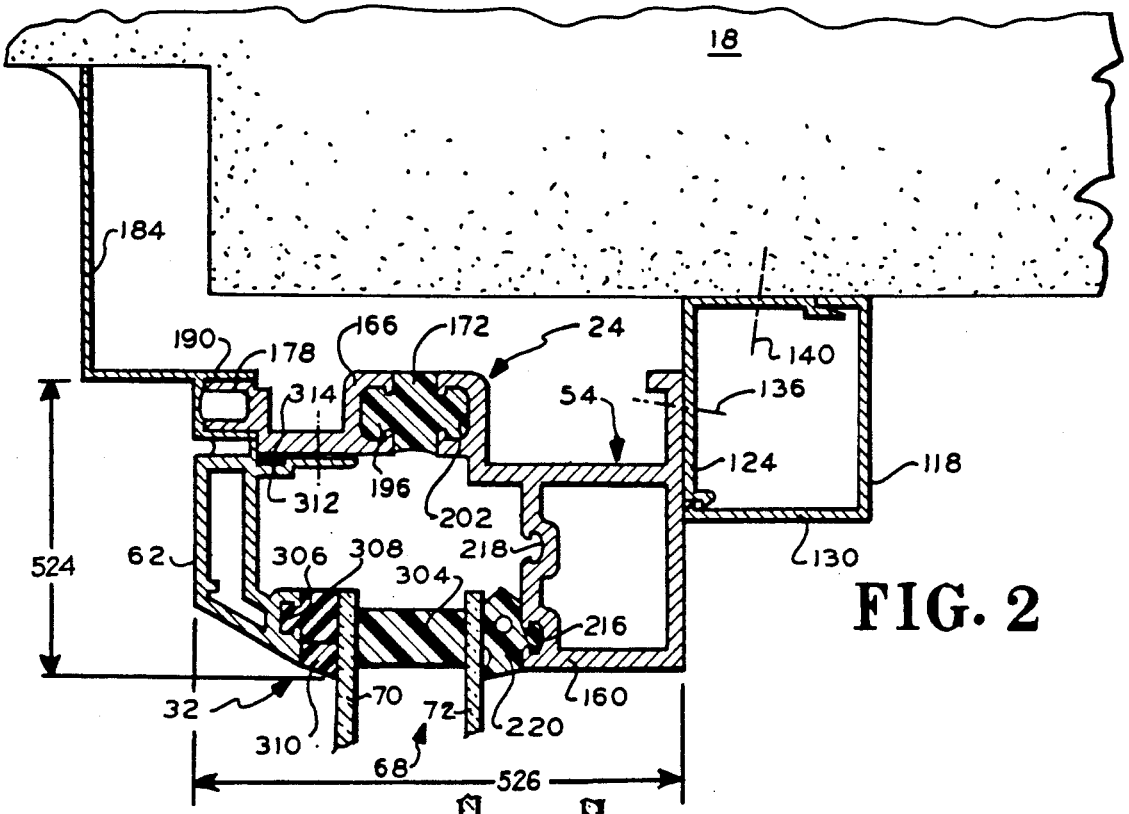
FIG. 2 is a section view as taken along line 2—2 of FIG. 1.

As shown in FIG. 2, top frame member 54 has lower and upper recesses 216, 218. Lower recess 216 has a continuous pressure wedge 220 made from Neoprene, for example.

As shown in FIG. 4, bottom frame member 52 has lower and upper recesses 222, 224 which have respective lower and upper seal members 226, 228. Lower seal member 226 is a tubular-type, primary, weather stripping seal member for the operable lights. Upper seal 228 is a sponge-type seal member. Again, typically, seal members 226 and 228 are made from Neoprene.

As shown in FIG. 5, right frame member 58 has first and second recesses 230, 232. In FIG. 5, first recess 230 has a continuous pressure wedge 234 to coact against glass unit 82 of the fixed window frame, 34.

As shown in FIG. 6, right frame member 58 has first and second recesses 236, 238. First recess 236 has a sponge-type seal member 240. Second recess 238 has a primary tubular-type, weatherstripping seal member 242.

Figure 8:
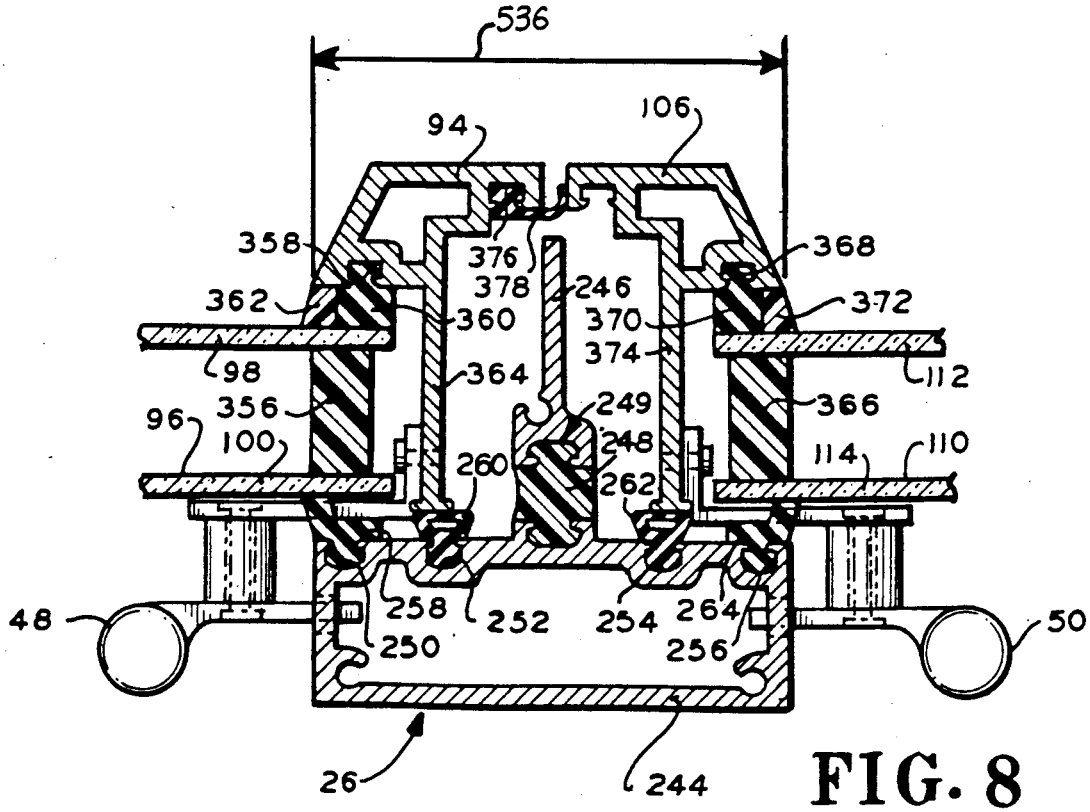
FIG. 8 is a section view as taken along line 8—8 of FIG. 1.

As shown in FIG. 8, mullion 26 has a main tubular portion 244 and a flange plate portion 246. Thermal break 248 is formed in the cavity 249, between flange plate portion 246 and main tubular portion 244 in the manner described above (see discussion re 170 above). Tubular portion 244 has four recesses 250, 252, 254, 256, when looking from the exterior. Recess 250 has a sponge-type seal member 258. Recess 252 has a primary tubular-type seal member 260 for the left operable window frame 96. Recess 254 has a primary tubular-type seal member 262 for right operable window frame 110. Recess 156 has a sponge-type seal member 264.

Figure 3:
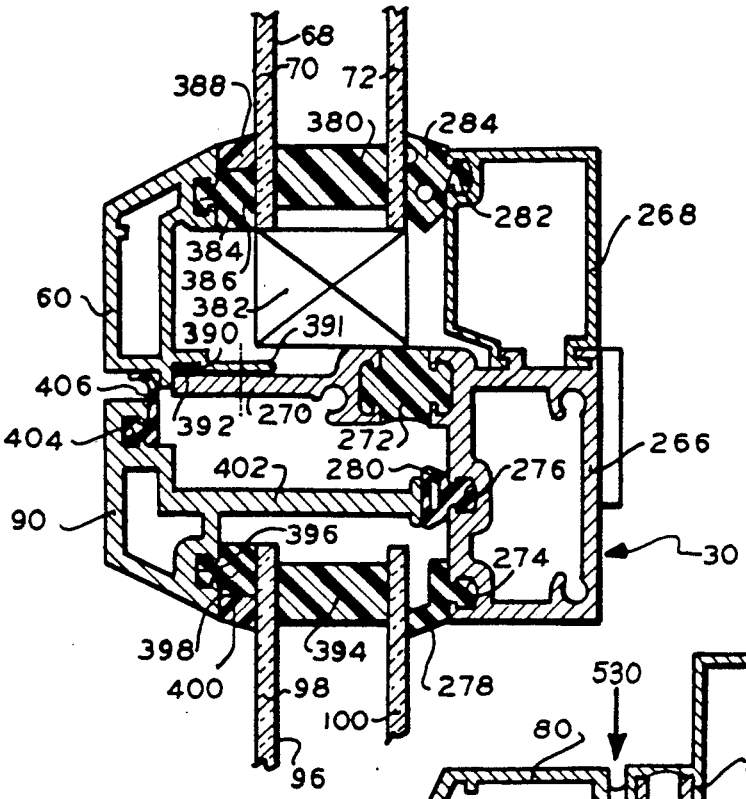
FIG. 3 is a section view as taken along line 3—3 of FIG. 1.

As shown in FIG. 3, horizontal bar 30 has a main tubular portion 266, and a supplementary tubular portion or glazing bead 268. Main tubular portion 266 and flange portion 270, have a thermal barrier or insert 272 formed therebetween. Main tubular portion 266 has bottom and top recesses 274, 276. Bottom recess 274 has a sponge-type seal member 278. Top recess 276 has a primary tubular-type weatherstripping member 280. Supplementary portion 268 has a recess 282, which has a fixed type seal member 284.

Figure 7:
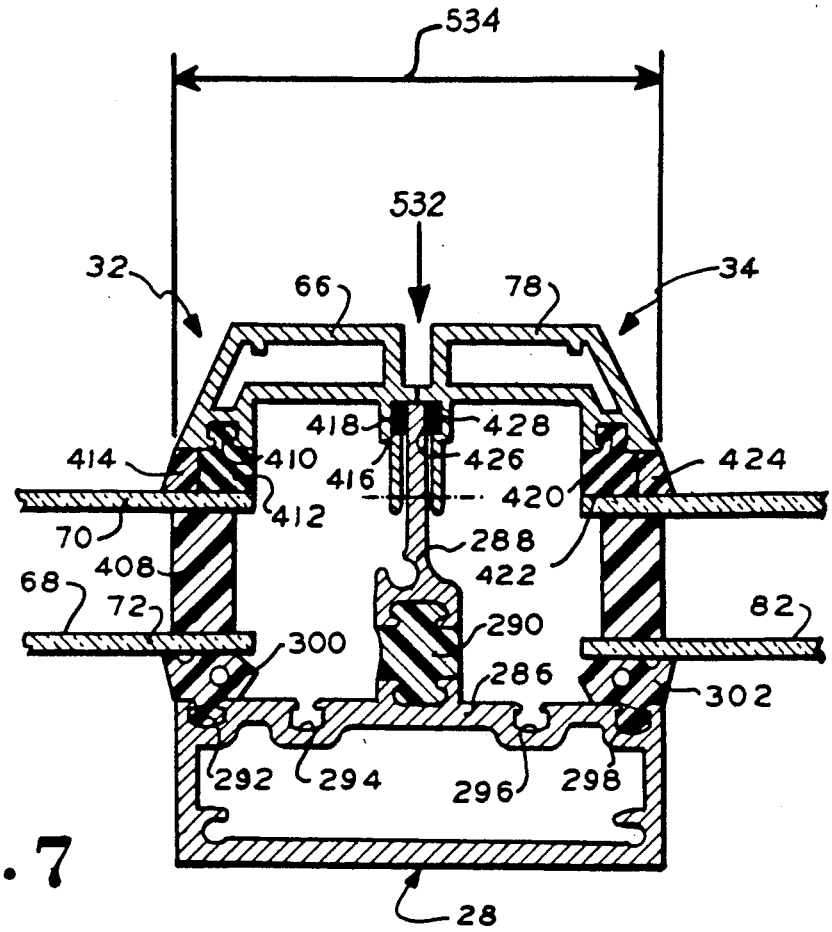
FIG. 7 is a section view as taken along line 7—7 of FIG. 1.

As shown in FIG. 7, the vertical post or rail 28 has a main tubular portion 286 and has a flange plate portion 288, with a thermal break or joint insert 290 formed therebetween. Post 28 has four recesses 292, 294, 296, 298, looking from the exterior. Recess 292 has a fixed-type seal member 300, for left fixed window frame 32. Recess 298 has a fixed-type seal member 302 for right fixed window frame 34.

All seals are composed of a resilient material, such as Neoprene rubber.

Inner frame 24 is a three-piece frame and includes inner tubular piece 158, 160, 162, insert piece 170, 172, 174, and outer flange piece 164, 166, 168.

As shown in FIG. 2, left fixed insulating glass unit 68 has an edge structural seal 304, which is disposed between its outer and inner sheets 70, 72. Seal 304 also acts as a vapor and air seal. It is constructed in a known fashion. Left top member 62 has a recess 306, which receives and exterior glazing gasket 308, that urges glass unit 68 against pressure wedge 220. A structural silicone seal 310 is disposed adjacent to gasket 308 and is disposed between glass unit 68 and left top member 62. When the silicone is cured, glass unit 68 becomes structurally monolithic with left top frame member 62. Silicone seal 310 allows for movement due to differences in thermal expansion. Silicone seal 310 also allows for foreshortening of glass sheets 70, 72, caused by a deflection due to wind load thereon.

Left top member 62, which is a tubular member, has a recess 312, which receives a seal material 314, for preventing rain seepage past left top member 62.

As shown in FIG. 4, left operable glass unit 96 also has an edge structural seal 316. Left operable bottom member 88 has a recess 318, which receives a glazing gasket 320, and has a structural silicone seal 322, which is fixedly connected to glass unit 96. Left operable bottom member 88 has an extension 324, which, in its closed position, engages primary seal 226; and has a continuous recess 326, which receives a continuous wiper secondary weatherstripping seal 328. Through the bond of structural silicone seal 222, glass unit 96 is supported by left operable bottom member 88 as a structurally monolithic composite such that sagging or parellelogramming of the operable or fixed frames is avoided.

As shown in FIG. 5, right fixed glass unit 82 also has an edge structural seal 330. Right fixed side member 80 has a recess 332, which has a glazing gasket 334, urging glass unit 82 against pressure wedge 234. Right fixed side member 80 also has a structural silicone seal 336; and has a recess 338, which receives a seal material 340.

As shown in FIG. 6, right operable glass unit 110, also has an edge structural seal 342. Right operable side member 108 has a recess 344, which has a support member 346, and has a structural silicone seal 348, which structurally connects the glass unit 110 to the support member 346 and operable side member 108 after curing. Right operable side member 108 also has an extension 350, which bears against seal 242 in a closed position; and has a recess 352, which has a secondary weatherstripping wiper seal 354. Hinge 46 is connected to right operable side member 108, adjacent to wiper seal 354.

As shown in FIG. 8, left operable glass unit 96, looking from the exterior, has a structural member 356 disposed between sheets 98, 100. Right member 94 of left frame 36 has a recess 358 with a support member 360, a silicon seal 362 and an extension 364, which bears against seal 260, and which supports lock handle 48. Right glass unit 110 also has a structural member 366 disposed between sheets 112, 114. Member 106 of right frame 42 has a recess 368 with a support member 370; and has a silicone seal 372. Member 106 also has an extension 374, which bears against seal 262, and which supports lock handle 50. Member 94 has a recess 376 with a wiper seal 378, which engages member 106.

As shown in FIG. 3, fixed glass unit 68, has a structural member 380 disposed between sheets 70, 72; and has a support block 382. Bottom fixed member 60 has a recess 384 with a support member 386, a silicone seal 388, and a recess 390 with seal material 392. Operable glass unit 96 also has a structural member 394 between sheets 98, 100. Top operable member 90 has a recess 396 with a support member 398, a silicone seal 400, an extension 402 which bears against seal 280, and a recess 404 with a wiper seal 406.

As shown in FIG. 7, left fixed glass unit 68 has a structural member 408, disposed between sheets 70, 72. Right member 66 of left fixed frame 32 has a recess 410 with a support member 412, a silicone seal 414, and a recess 416 with seal material 418. Left member 78 of right fixed frame 34 also has a recess 420 with a support member 422, a silicone seal 424, and a recess 426 with seal material 428.

Figure 9:
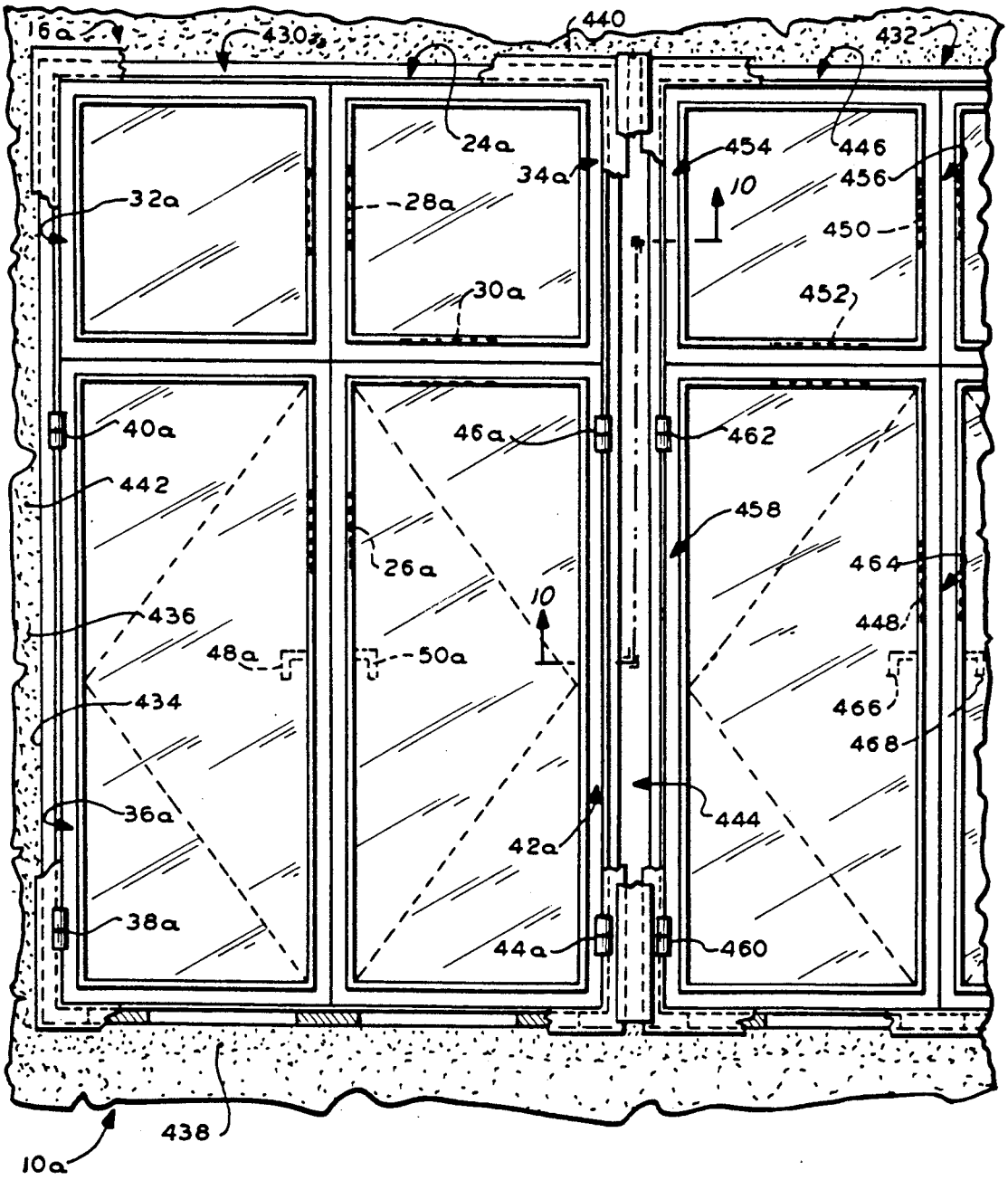
FIG. 9 is an exterior elevation view of another embodiment of a window structure according to the invention; and, FIG. 10 is a section view as taken along line 10—10 of FIG. 9.

FIG. 9 shows an alternate embodiment of window system 10. Parts of system 10 in FIG. 9, which are the same as parts of system 10 in FIGS. 1 through 8 have the same numerals, but with a subscript "a", added thereto.

Figure 10:
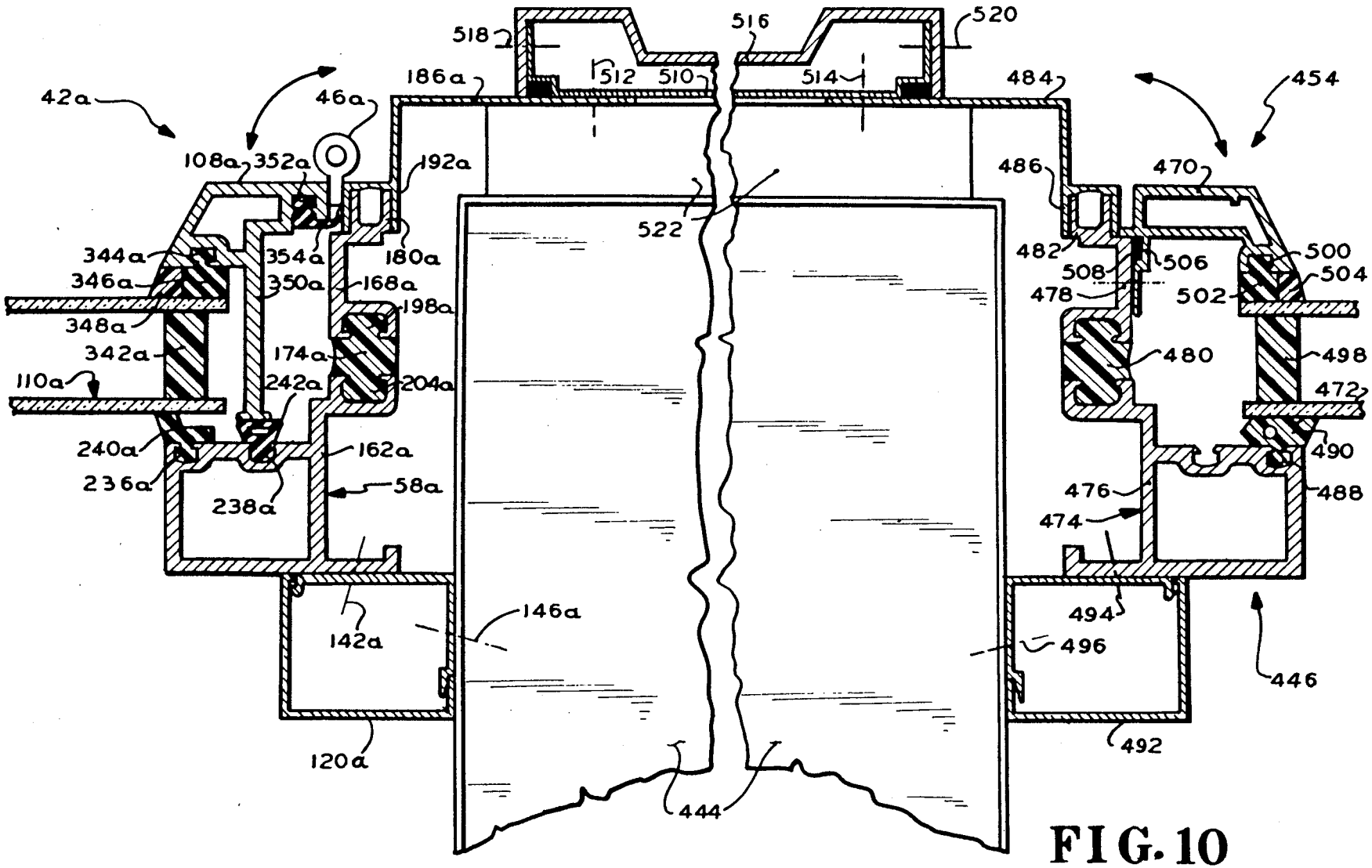

FIG. 9 shows a first window portion 430 and a second window portion 432, which fits into wall opening 434 of a wall 436. Wall 436, when looking from the exterior, has a bottom portion 438, a top portion 440, and a left portion 442. Wall 436 has an intermediate structural mullion 444 (FIG. 10).

As shown in FIG. 9, first window portion 430 includes an inner frame 24*a*, a vertical mullion 26*a*, a vertical upper post 28*a* and a horizontal bar 30*a*. Frame 24*a*, mullion 26*a*, post 28*a*, and bar 30*a* are tubular members.

First window portion 430 has a left fixed window frame 31*a* and a right fixed window frame 34*a*. Portion 430 has a left operable outswing window frame 36*a*, which has side hinges 38*a*, 40*a*; and has a right operable outswing window frame 42*a*, which has side hinges 44*a*, 46*a*. Left and right window frames 36*a*, 42*a* have respective lock handles 48*a*, 50*a*.

Second window portion 432 also has an inner frame 446, a vertical mullion 448, a vertical upper post 450, and a horizontal bar 452, which are tubular members. Second window portion 432 also has a left fixed window frame 454, a right fixed window frame 456, a left operable outswing window frame 458, with hinges 460, 462, and a right operable outswing window frame 464. Left and right operable window frames 458, 464 have respective lock handles 466, 468.

As shown in FIG. 10, right operable window frame 42*a* of first window portion 430 has a right operable member 108*a* and an operable insulating glass unit 110*a*. Inner frame 24*a* has a right frame member 58*a*, which has a main tubular portion 162*a* and a flange plate portion 168*a*. Flange 168*a* has a thermal insert 174*a* and an enlarged edge portion 180*a*. Flange 168*a* also has a panning member 186*a* with a snap-on edge portion 192*a*. Tubular portion 162*a* has a first recess 236*a* with a pressure wedge 240*a*; and has a second recess 238*a* with a primary tubular seal 242*a*. Right frame member 58*a* has a two-piece trim member 120*a* with screws 142*a*, 146*a*. Insert 174*a* has opposite connector edges 198*a*, 204*a*.

As shown in FIG. 10, right operable glass unit 110*a* of first window portion 430 has a structural seal 342*a*. Right operable side member 108*a* has a recess 344*a*, which has a support member 346*a*, and has a structural silicone seal 348*a*; and has an extension 350*a*; and has a recess 352*a* with a wiper seal 354*a*; and has a hinge 46*a*.

As shown in FIG. 10, when viewed from the exterior of second window portion 432, left fixed window frame 454 has a left fixed member 470 and a fixed insulating glass unit 472. Inner frame 446 has a left frame member 474, which has a main tubular portion 476 and a flange plate portion 478. Flange 478 has an insert 480; and has an enlarged edge portion 482. Flange 478 also has a panning member 484 with a snap-on edge portion 486. Tubular portion 476 has a recess 488 with a fixed seal 490. Left frame member 474 has a two-piece trim member 492 with screws 494, 496.

As shown in FIG. 10, left fixed glass unit 472 of second window portion 432 has a structural seal 498. Left fixed member 470 has a recess 500, which has a support member 502; and has a structural silicon seal 504; and has a recess 506 with seal material 508.

Panning member 484 has an inner cover 510 with screws 512, 514, and has an outer cover 516 with screws 518, 520. Structural mullion 444 has a wood blocking 522 for a back-up for panning members 186*a*, 484 and covers 510, 516. Silicone weather seals 524, 526 are disposed between panning members 186*a*, 484 and covers 510, 516.

The advantages of the new window system as compared to the prior art are indicated hereafter:

1. A conventional outswing, aluminum window frame derives its strength from the height of the extrusion, usually 2¼" high. Operable portions are positioned on top, adding up to 3" to 4" total height. Further, the 2¼" high, fixed portion usually includes a removable ¾" high glazing stop or bead which precludes overlapping up to the glass line of the interior closure or decorative interior trim. Thus the replacement window must be positioned high over the old frame or trim.

The new perimeter frame, with 2" sight line (524, FIG. 2) but depth of over 3", (526, FIG. 2) comprises a heavy tubular portion right up to the glass sight line or interior. This frame configuration offers adequate strength for resistance to twist and permanent deformation during manufacture, delivery, installation and use.

Because of the new 2" high perimeter frame, the positioning of the whole window is not limited by location of the interior glazing bead because there is none. Therefore, the whole frame can be located close to the perimeter construction. This is especially important for replacement work which requires leaving in place the existing perimeter window frame.

Additionally, a 2" high perimeter sight line allows multiple separate windows, when mullioned together to have a 4" glass-to-glass dimension across mullion as is the case with the old steel windows.

2. The second advantage of the tubular, structural portion (e.g.158, FIG. 4) of the perimeter frame coming up to the glass line is that the extrusion provides sufficient height to inwardly overlap the outward moving ventilators. Necessary weathering seals (228, 226, FIG. 4) are incorporated into the exterior vertical wall of the tubular portion. Key way (222, e.g.) for the primary seal (226) is located ¾" down from opening. This allows the ventilator member (364, FIG. 8) to compress the primary weatherstrip uninterrupted by the locking handle bracket (see FIG. 8), which must pass from ventilator extension (364, FIG. 8), up behind the glass, through area of secondary exposed weatherstrip (258). An uninterrupted, primary seal, required for effective pressure equalization and necessary for effective resistance to water penetration as well as air penetration, is maintained. Interior secondary seal (258) is provided to minimize the migration of chilled air from the ventilator member into the building interior.

3. Additionally, interior secondary weatherstrip key way (216, FIG. 2) allows for lock of continuous interior compression wedge seal (220, FIG. 2) at fixed lights.

4. Effective weather resistance requires, along with the effective interior seal for pressure equalization, a dam incorporated into the sill of the window to allow a head of water which will penetrate into the cavity under the ventilator by kinetic or other means. By definition, a window having a low profile does not have much room for a high dam. The new window, by having its structural frame right up to the interior glass line, does in fact provide a water head approximately 1¼", sufficient for high performance requirements (i.e., an ability to drain in presence of high winds), without impacting the desired sight line (see FIG. 4). Often, conventional windows, can have extra water dams incorporated into the sill only. In order to derive the manufacturing simplicity and appearance advantages of simple 45 degree mitered corner construction (welding or crimped corner-key methods), the new window can handle water head requirements wholly within its 2" height.

5. The perimeter frame also incorporates a poured and debridged polyurethane thermal barrier separation (170, FIG. 4) located approximately mid-point. This allows use of ⅞" wide, exterior to interior, 4-bar scissor-type cleaning hinges connected between members 164 and 324, for example, in FIG. 4, for outward projecting "casement" or "awning" ventilators, without bridging thermal separation caused by contact with ventilator which has no thermal separation per se.

6. Perimeter frame further has provision for exterior snap-on member (176, FIG. 4) which, for retrofit, or new construction, allows at very low cost, exterior trim or panning (182) to be applied. Depending on user requirements, needed width can be added to the frame; or alternately custom or classical molding shapes (cyma, recta, ovolo, conge, etc.) can be provided. Because fixed and operable lights are separate mitered corner elements, their exterior contours can be altered in like manner with simple custom extrusions without changing window construction methods or materials. Two further advantages derive from this exterior trim in its role as part of the cohesive, entire window design concept. First of all, the trim is located on the frame in relation to the fixed or operable light portions so that aesthetically desirable continuous articulation (narrow reveal) (528, FIG. 4) exists around the window. Secondly, because no interior portion of the frame is exposed to exterior, the trim panning which is required for most purposes anyway (particularly in retrofit construction) allows the frame to have an exterior color different from the interior color, thus avoiding the usually costly double painting or attaching of two different color extrusions. Further, the trim piece can be made of low thermal conducting material (e.g., vinyl) so as to eliminate the need for the thermal separation in the perimeter frame per se.

7. The outward moving ventilator extrusion, for example, 88, FIG. 4, has the same exterior contour and dimensions as an outside putty glazed window ventilator. Its juxtaposition to other ventilators, fixed lights and perimeter frame result in the same appearance as the steel windows, with continuous reveal between members, (528, FIG. 4; 530, FIG. 5; 532, FIG. 7). It is provided with a key way (318, FIG. 4) for spacer seal (320) which acts as backer for a continuous silicone exterior structural bond bead/weather seal (322). It is also provided with a key way (326 FIG. 4) for an exterior secondary leaf-type weatherstrip (328) which has two functions: first of all, it provides a rain-screen to minimize the amount of water entering the pressure-equalization cavity; secondly, it hides the color of the interior window members from exterior view, which might otherwise be seen through the articulation reveal.

8. The fixed light exterior member has the same exterior shape and appearance as the ventilator (see FIG. 3), (and therefore the steel windows). The joint (532, FIG. 7) between a fixed light and other fixed lights or the perimeter frame can be sealed flush; or recessed to simulate what was once deluxe "sight lining" of fixed light to ventilators in old steel windows. The fixed light exterior member is provided with a key way (384, FIG. 3) for an exterior seal (386) which is visible for dry glazing in conjunction with interior continuous pressure wedge (284); or is recessed for exterior wet seal. It is provided, with an interior leg (391, FIG. 3) which after mitering and joining is screwed to the perimeter frame (168, FIG. 5) or internal framing bars, (e.g. 270). This is typical and pertains to the various "interior" legs depicted throughout the figures.

9. The internal transverse structural framing members, such as 28 and 30, constitute the means by which the new aluminum window (again a material with ⅓ the strength of steel) can be fabricated at low cost and still match the 3" (534, FIG. 7; 536, FIG. 8), glass-to-glass dimension of steel windows. The full-tee (28) and half-tee (30) members are used in combination or singly to allow one or more fixed lights to be combined with one or more operable lights in any combination as with the steel windows. This is accomplished with only one removable interior glazing bead (268, FIG. 3) per fixed light incorporated into the half-tee member only (none being used at the perimeter frame members). It is necessary that the tee members have a section modulus and a moment of inertia so that acting as a simple beam, with ends pinned, it provides the necessary windload resistance. If there were two conventional interior glazing beads for fixed lights, the strength of the member would be so far reduced as to be useless for most performance criteria.

As designed, means for glazing and reglazing fixed lights from the interior are provided. This is accomplished by so-called "tuck" or "jiggle" glazing which requires at least one glazing pocket, minimum 1¼" deep, adjoining (at 90 degrees) one, 1¼" high, removable glazing bead, (see FIG. 3). The new window has 1¼" deep glazing pockets on both sides of full tee (see FIG. 7; and on one side of half-tee (FIG. 3) and on all perimeter frame members (see FIG. 5). As can be seen in FIG. 3 this allows, regardless of quantity or location of operable lights, at least one removable stop per fixed light while allowing a full or half-tee, in one direction or another, to run continuously across the whole frame, thus preserving the structural integrity of the tee. Crosswise tees are thus stronger than necessary, but full size must be maintained for aesthetic reasons. Transverse structural members of old steel windows were specially end-cut and butt-welded to a section of a different function (vent-to-vent, vent-to-fixed). The nature of aluminum itself and finishing methods virtually precludes aluminum windows from being manufactured in this fashion. Not coping effectively and economically with this stubborn fact, is why outswing aluminum windows, until the present invention, have become fatter and flatter and look not at all like the old, slim, elegant, putty glazed steel windows.

Further, the relationship of ventilator with either side of the full-tee or one side of the half-tee is the same as its relationship with the perimeter frame (i.e., primary weather seal, interior secondary seal, scissor hinges) with one exception; and that is where two ventilators are juxtaposed to each other at a full tee, since only one ventilator will have an exterior, secondary, weather seal (378, FIG. 8) on the side they adjoin.

In addition, the relationship of fixed glass and exterior and interior glazing seals is the same at full tee and the tubular side of the half-tee as at the perimeter frame (see FIGS. 2, 3, 5 and 7). The removable glazing bead (268) on the half-tee is installed after the glass is properly slipped (or "tucked" or "jiggled") to achieve the industry mandated, ½" bite on three sides of glass. The glass is supported on ¼ point blocks (382, for example). The rolling in of the continuous pressure wedge (284) between the glass and bead (268) secures the "hook-on" bead in position and creates a tight glazing seal. When the bead is at the bottom of the glass, additional wet seals may be required, particularly for windows in very high buildings which are subject to high pressure differentials.

10. Regardless of its function and appearance, good window design attempts to incorporate as much tried-and-true operating hardware and manufacturing methods and materials as there can be found in the marketplace. The advantages in so far as long-term viability and ease of replacement are obvious. What can be difficult, and heretofore inachievable, is the incorporation of these standardized items into a new configuration. The new design uses existing components in spite of greatly reduced height dimensions (5" to 3").

FIG. 8 depicts what might be a typical arrangement of locking hardware. Generally, locking hardware can be of three types:

(a) where a standard lock is mounted on an angle extrusion attached to ventilator, a cam handle pawl engages a strike surface placed in a recessed keeper. Screens to accommodate this type of arrangement would be inwardly protruding-frame hinged or wicket type.

(b) where it is desired that the cam handle not be visible from the exterior, standard hook-type, casement locks can be provided on the internal tubular wall of the frame or tee. It would engage the strike on the ventilator through hole in the tubular walls.

(c) Vent (side hinged or awning out-projecting) would be opened and closed either by pull mounted on vent-connected angle or by crank operated devices mounted on interior surface of tubular portion of tee or frame with operating arm moving through milled slot provided. With this device, flat fixed screens can be provided.

11. For commercial, institutional and particularly residential retrofits, and new construction, there exists a requirement to have the interior color of windows match the interior decor. Because the new window's interior surfaces are not exposed to the exterior, they can be factory finished in any color desired. Repainting to satisfy needs for new decor (or new tenants' desires), is easy with old steel windows or with wood windows. Conventional aluminum windows, interiors have exposed weather seals or ventilator surfaces and other voids and interstices which, if hand painted, can destroy much of the window's operating and performance usefulness. The new window on the other hand, has no ventilator exposed to the interior and no voids to foul up. In manufacture, the interior can be provided with a prime paint, obviating expensive preparation before the final coat or, repainting.

Figure 11:
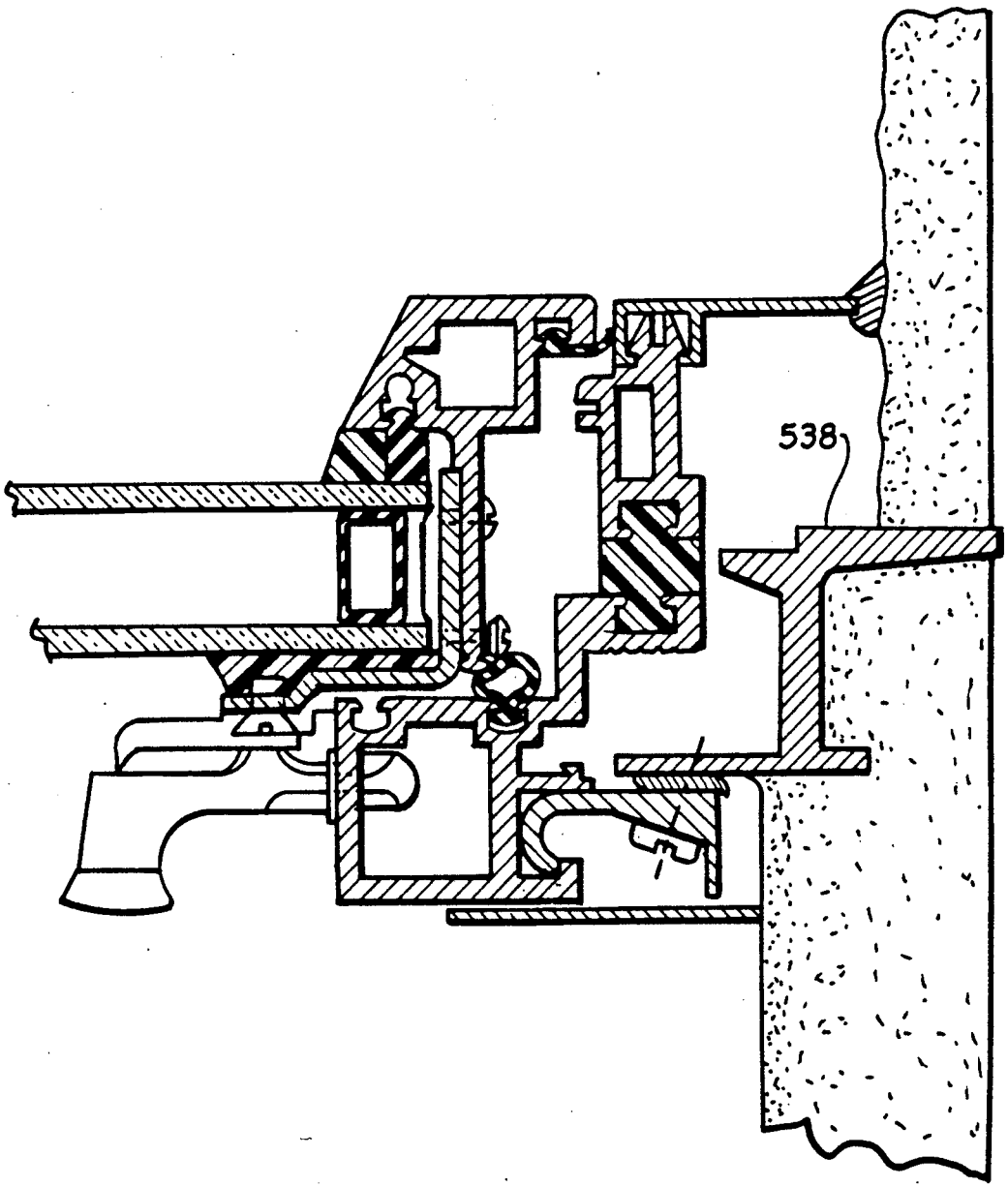
FIG. 11 is a section view of an embodiment of the invention depicting the new window system being used to replace old steel windows.

In replacing old steel windows it is usually desirable to leave the perimeter frame in place, anchored to and embedded in the existing wall. Removing the whole frame can damage fragile old walls. The new window, because its tubular perimeter structural component is located towards the opening, can be configured to nestle-down over the old steel frame (538, see FIG. 11), further reducing the replacement window's intrusion into vision and light area.

While the preferred embodiment has described a window system comprising at least one fixed light and one casement type, operable light, the invention is to be understood as to extend to any combination of at least one fixed unit (light or opaque panel); and at least one operable unit (casement, outswing or out-projecting, project out awning, etc.).

While the invention has been described in its preferred embodiment, it is to be understood that the words which have been used are words of description, rather than limitation and that changes may be made within the purview of the appended claims without departing from the true scope and spirit of the invention in its broader aspects.

The embodiments of an invention in which an exclusive property or right is claimed are defined as follows:

1. A window structure for a wall opening comprising:

a perimeter frame having a first frame portion and having a second flange plate portion;

at least one interior meeting rail member interposed between two segments of said first frame portion of said perimeter frame, said interior meeting rail having a first frame portion and having a second flange plate portion;

an exterior fixed frame member fixedly connected to the perimeter frame and the interior meeting rail;

an exterior operable frame member hingedly connected to the perimeter frame, or the interior meeting rail, in a manner such that said operable frame member outswings from said wall opening;

said exterior frame members exposed to the environment outside the wall opening, such that they acquire the temperature of the outside environment, said first frame portions of said perimeter frame and said interior meeting rail exposed to the environment inside the wall opening, such that they acquire the temperature of the inside environment;

means for thermally isolating said exterior frame members from said first frame portions of said perimeter frame and of said interior meeting rail;

a two-piece fixed insulating glass unit mounted between the exterior fixed frame and the first frame portions of the perimeter frame and the meeting rail;

a two-piece operable insulating glass unit mounted on the exterior operable frame member;

said exterior operable frame member including an inwardly directed extension member;

a first continuous primary seal member supported by the first frame portions of said perimeter frame and the interior meeting rail member for engaging the two-piece fixed insulating glass unit mounted on the exterior fixed frame;

a second continuous primary seal member engagingly disposed between the inwardly directed extension member and corresponding portions of the first frame portions of said perimeter frame and said interior meeting rail;

respective secondary seal members supported by the first frame portions of the perimeter frame and the interior meeting rail member for engaging said operable glass unit; and, locking hardware means for securing in a closed position said exterior operable frame member including a portion secured to a respective one of said first frame portions and including a portion engaging said perpendicular extension member and extending past a closely proximate secondary seal member into the interior where it can be operated by the user to engage the portion secured to the first frame portion;

said interior meeting rail having a minimum section modulus and a minimum moment of inertia so that acting as a simple beam, with its ends connected, each said meeting rail provides the necessary wind-load resistance for a particular application while permitting a total sight line of three inches glass to glass and two inch sight line glass to building at the perimeter frame.

2. A window structure for a wall opening comprising:

a perimeter frame having a first frame portion and having a second flange plate portion;

a first interior meeting rail member interposed between two segments of said first frame portion of said perimeter frame, said first interior meeting rail having a first frame portion and a second flange plate portion;

a second interior meeting rail member interposed between complementing segments of the first frame portions of said perimeter frame and the first interior meeting rail, said second interior meeting rail having a first frame portion and a second flange plate portion;

a left exterior fixed frame member fixedly connected to the perimeter frame and at least one of said meeting rails;

a right exterior fixed frame member fixedly connected to the perimeter frame and at least one of said meeting rails;

a left exterior operable frame member hingedly connected to the perimeter frame or a portion of the first or second interior meeting rails in a manner such that said left operable frame member outswings from said wall opening;

a right exterior operable frame member hingedly connected to the perimeter frame or a portion of the first or second interior meeting rails in a manner such that said right operable frame member outswings from said wall opening;

said exterior frame members exposed to the environment outside the wall opening, such that they acquire the temperature of the outside environment, said first frame portions of said perimeter frame and said interior meeting rails exposed to the environment inside the wall opening, such that they acquire the temperature of the inside environment;

means for thermally isolating said exterior frame members from said first frame portions of said perimeter frame and of said interior meeting rails;

a left two-piece fixed insulating glass unit mounted between the left exterior fixed frame and the first frame portions of the perimeter frame and the meeting rails;

a right two-piece fixed insulating glass unit mounted between the right exterior fixed frame and the first frame portions of the perimeter frame and the meeting rails;

a left two-piece operable insulating glass unit mounted on the left exterior operable frame member;

a right two-piece operable insulating glass unit mounted on the right exterior operable frame member;

said exterior operable frame members each including an inwardly directed extension member;

a first continuous primary seal member supported by the first frame portions of said perimeter frame and the interior meeting rail members for engaging the two-piece fixed insulating glass units mounted on the exterior fixed frames;

a second continuous primary seal member engagingly disposed between the inwardly directed extension members and corresponding portions of the first frame portions of said perimeter frame and said interior meeting rails;

respective secondary seal members supported by the first frame portions of the perimeter frame and the interior meeting rail members for engaging respective operable glass units; and, locking hardware means for securing in a closed position each exterior operable frame member including a respective portion secured to a respective one of said first frame portions and including a respective portion engaging a respective one of said perpendicular extension members and extending past a closely proximate secondary seal member into the interior where it can be operated by the user to engage the respective portion secured to the first frame portions;

said interior meeting rail having a minimum section modulus and a minimum moment of inertia so that acting as a simple beam, with its ends connected, each said meeting rail provides the necessary wind-load resistance for a particular application while permitting a total sight line of three inches glass to glass and two inch sight line glass to building at the perimeter frame.

3. The structure claimed in either claim 1 or 2, including a head panning member;

a sill panning member; and first and second jamb panning members;

said panning members adapted for engaging the second flange plate portion and extending therefrom.

4. The structure of claim 3, wherein the first frame portions of said perimeter frame have a two-piece hollow trim assembly including a first trim piece attached to the wall and a second trim piece with a snap-on connection for connecting the second trim piece to the first trim piece.

5. The structure of claim 3 wherein each of said exterior operable frames include at least one wiper seal member, said wiper seal members coacting with respective ones of said exterior operable frames and said panning members to impede the penetration of rain and to hide the appearance of the interior window frame portions when said exterior operable frames are in a closed position.

6. The structure of claim 3 wherein said second jamb panning member has a cover assembly connected thereto and extending therefrom for overlapping a jamb panning member of an adjacent window structure.

7. The window structure claimed in either claim 1 or claim 2 wherein at least one of said meeting rails includes a main portion and a removeable supplementary portion, whereby the glazing and reglazing of said fixed insulating glass units from the interior can be accomplished.

8. The window structure claimed in either claim 1 or 2 wherein portions of at least one of the perimeter frame, first meeting rail, second meeting rail, exterior fixed frame members and exterior operable frame members are tubular.

9. The window structure claimed in claim 8 wherein the tubular members are made of extruded aluminum.

10. The window structure claimed in claim 9 wherein certain portions of said first and second meeting rails have a predetermined section modulus and moment of inertia such that necessary windload resistance is provided.

11. The window structure claimed in either claim 1 or 2 wherein each of the exterior operable frame members is a casement frame member.

12. The window structure claimed in claim 5 wherein the exterior fixed frame and exterior operable frame overlap and have substantially the same projected width as the corresponding interior frame so that said interior frame is not visible from the exterior when the exterior operable frames have been closed shut.

13. The window structure claimed in claim 12 wherein the exterior fixed and operable frames have a predetermined contour and dimensions whereby they simulate outside putting glazed steel windows including aesthetically desirable continuous articulation around the perimeter of the window structure and around each and between the fixed and operable exterior frames.

14. The window structure claimed in claim 12, wherein the sight line is two inches at the perimeter of the window structure and three inches, glass to glass.

15. The window structure claimed in either claim 1 or claim 2 wherein said means for thermally isolating said exterior fixed frame members from said first frame portions of said perimeter frame and of said interior meeting rails includes a heat barrier portion disposed between the first frame portions of the perimeter frame and the interior meeting rails, and the corresponding second flange plate portions wherein said heat barrier is formed from polyurethane and wherein said first frame portions and said second flange plate portions are first connected together by a bridging member, said bridging member cut out after said polyurethane has set.

16. A window structure for a wall opening comprising:

a perimeter frame having a first frame portion and having a second flange plate portion;

at least one interior meeting rail member interposed between two segments of said first frame portion of said perimeter frame, said interior meeting rail having a first frame portion and having a second flange plate portion;

an exterior fixed frame member fixedly connected to the perimeter frame and the interior meeting rail;

an exterior operable frame member hindedly connected to the perimeter frame, or the interior meeting rail, in a manner such that said operable frame member outswings from said wall opening;

said exterior frame members exposed to the environment outside the wall opening, such that they acquire the temperature of the outside environment, said first frame portions of said perimeter frame and said interior meeting rail exposed to the environment inside the wall opening, such that they acquire the temperature of the inside environment;

means for thermally isolating said exterior frame members from said first frame portions of said perimeter frame and of said interior meeting rail;

a fixed light unit mounted between the exterior fixed frame and the first frame portions of the perimeter frame and the meeting rail;

an operable light unit mounted on the exterior operable frame member;

said exterior operable frame member including an inwardly directed extension member;

a first continuous primary seal member supported by the first frame portions of said perimeter frame and the interior meeting rail member for engaging the fixed light unit mounted on the exterior fixed frame;

a second continuous primary seal member engagingly disposed between the inwardly directed extension member and corresponding portions of the first frame portions of said perimeter frame and said interior meeting rail;

respective secondary seal members supported by the first frame portions of the perimeter frame and the interior meeting rail member for engaging said operable light unit; and, locking hardware means for securing in a closed position said exterior operable frame member including a portion secured to a respective one of said first frame portions and including a portion engaging said perpendicular extension member and extending past a closely proximate secondary seal member into the interior where it can be operated by the user to engage the portion secured to the first frame portion;

said interior meeting rail having a minimum section modulus and a minimum moment of inertia so that acting as a simple beam, with its ends connected, each said meeting rail provides the necessary windload resistance for a particular application while permitting a total sight line of three inches glass to glass and two inch sight line glass to building at the perimeter frame.

17. A window structure for a wall opening comprising:

a perimeter frame having a first frame portion and having a second flange plate portion;

a first interior meeting rail member interposed between two segments of said first frame portion of said perimeter frame, said first interior meeting rail having a first frame portion and a second flange plate portion;

a second interior meeting rail member interposed between complementing segments of the first frame portions of said perimeter frame and the first interior meeting rail, said second interior meeting rail having a first frame portion and a second flange plate portion;

a left exterior fixed frame member fixedly connected to the perimeter frame and at least one of said meeting rails;

a right exterior fixed frame member dfixedly connected to the perimeter frame and at least one of said meeting rails;

a left exterior operable frame member hingedly connected to the perimeter frame or a portion of the first or second interior meeting rails in a manner such that said left operable frame member outswings from said wall opening;

a right exterior operable frame member hingedly connected to the perimeter frame or a portion of the first or second interior meeting rails in a manner such that said right operable frame member outswings from said wall opening;

said exterior frame members exposed to the environment outside the wall opening, such that they acquire the temperature of the outside environment, said first frame portions of said perimeter frame and said interior meeting rails exposed to the environment inside the wall opening, such that they acquire the temperature of the inside environment;

means for thermally isolating said exterior frame members from said first frame portions of said perimeter frame and of said interior meeting rails;

a left fixed light unit mounted between the left exterior fixed frame and the first frame portions of the perimeter frame and the meeting rails;

a right fixed light unit mounted between the right exterior fixed frame and the first frame portions of the perimeter frame and the meeting rails;

a left operable light unit mounted on the left exterior operable frame member;

a right operable light unit mounted on the right exterior operable frame member;

said exterior operable frame members each including an inwardly directed extension member;

a first continuous primary seal member supported by the first frame portions of said perimeter frame and the interior meeting rail members for engaging the fixed light units mounted on the exterior fixed frames;

a second continuous primary seal member engagingly disposed between the inwardly directed extension members and corresponding portions of the first frame portions of said perimeter frame and said interior meeting rails;

respective secondary seal members supported by the first frame portions of the perimeter frame and the interior meeting rail members for engaging respective operable light units; and, locking hardware means for securing in a closed position each exterior operable frame member including a respective portion secured to a respective of said first frame portions and including a respective portion engaging a respective one of said perpendicular extension members and extending past a closely proximate secondary seal member into the interior where it can be operated by the user to engage the respective portion secured to the first frame portions;

said interior meeting rail having a minimum section modulus and a minimum moment of inertia so that acting as a simple beam, with its ends connected, each said meeting rail provides the necessary windload resistance for a particular application while permitting a total sight line of three inches glass to glass and two inch sight line glass to building at the perimeter frame.

18. A window structure for a wall opening having a perimeter frame said perimeter frame having a first frame portion and having a second flange plate portion, said window structure comprising:

a grid network placed in and fixedly secured to said perimeter frame, said grid network including at least a first and second meeting rail, each of said first and second meeting rails having a first frame portion and having a second flange plate portion, said first meeting rail interposed between two opposite segments of the first frame portions of other meeting rails in said grid network, or interposed between two opposite segments of the first frame portion of said perimeter frame, or interposed between two opposite segments of the first frame portions of another meeting rail and said perimeter frame, said second meeting rail interposed between a segment of the first frame portion of said first meeting rail and another meeting rail or said perimeter frame, said connecting first and second meeting rails forming at least a part of said grid network whereby said grid network has a minimum of three window receiving openings;

at least three exterior frame members hingedly or fixedly connected to corresponding portions of said meeting rails or said perimeter frame, said exterior frame members positioned in said window receiving openings, those of said exterior frame members which are fixedly connected to corresponding portions of said meeting rails or said perimeter frame hereinafter referred to as exterior fixed frame members, those of said exterior frame members which are hingedly connected to said meeting rails or said perimeter frame being operably connected whereby each said operable exterior frame member outswings from said corresponding window opening;

said exterior frame members exposed to the environment outside the wall opening, such that they acquire the temperature of the outside environment, said first frame portions of said perimeter frame and said interior meeting rails exposed to the environment inside the wall opening, such that they acquire the temperature of the inside environment;

means for thermally isolating said exterior frame members from said first frame portions of said perimeter frame and of said interior meeting rails;

a two-piece fixed insulating glass unit mounted between the exterior fixed frame and the first frame portions of the perimeter frame and the meeting rails;

a two-piece operable insulating glass unit mounted on the exterior operable frame members;

each of said exterior operable frame members including an inwardly directed extension member;

a first continuous primary seal member supported by the first frame portions of said perimeter frame and the interior meeting rail members for engaging the two-piece fixed insulating glass unit mounted on the corresponding exterior fixed frame;

a second continuous primary seal member engagingly disposed between the inwardly directed extension member and corresponding portions of the first frame portions of said perimeter frame and said interior meeting rails;

respective secondary seal members supported by the first frame portions of the perimeter frame and the interior meeting rail members for engaging said operable glass unit; and, locking hardware means for securing in a closed position said exterior operable frame members including a portion secured to a respective one of said first frame portions and including a portion engaging said perpendicular extension member and extending past a closely proximate secondary seal member into the interior where it can be operated by the user to engage the portion secured to the first frame portion, said interior meeting rail having a minimum section modulus and a minimum moment of inertia so that acting as a simple beam, with its ends connected, each said meeting rail provides the necessary wind-load resistance for a particular application while permitting a total sight line of three inches glass to glass and two inch sight line glass to building at the perimeter frame.

19. The window structure claimed in claim 18 wherein said two piece insulating glass units are replaced, as the user requires, with light units.

* * * * *

UNITED STATES PATENT AND TRADEMARK OFFICE

CERTIFICATE OF CORRECTION

PATENT NO. : 5,038,537

DATED : August 13, 1991

INVENTOR(S) : Harry Frambach, Allendale, NJ

It is certified that error appears in the above–identified patent and that said Letters Patent is hereby corrected as shown below:

IN THE CLAIMS: At Column 15, line 39, change the word "putting" to --putty--.

At Column 17, line 4, change the word "dfixedly" to --fixedly--.

Signed and Sealed this

Sixteenth Day of February, 1993

*Attest:*

STEPHEN G. KUNIN

*Attesting Officer*

*Acting Commissioner of Patents and Trademarks*